US007478614B2

(12) United States Patent
Nakamura et al.

(10) Patent No.: US 7,478,614 B2
(45) Date of Patent: Jan. 20, 2009

(54) VARIABLY OPERATED VALVE SYSTEM FOR COMPRESSION IGNITION ENGINE

(75) Inventors: Makoto Nakamura, Kanagawa (JP); Seinosuke Hara, Kanagawa (JP); Seiji Suga, Kanagawa (JP); Masahiko Watanabe, Kanagawa (JP); Tomio Hokari, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 154 days.

(21) Appl. No.: 11/367,587

(22) Filed: Mar. 6, 2006

(65) Prior Publication Data

US 2006/0236960 A1 Oct. 26, 2006

(30) Foreign Application Priority Data

Apr. 26, 2005 (JP) ..... 2005-127788

(51) Int. Cl.
*F01L 1/34* (2006.01)

(52) U.S. Cl. ..... 123/90.15; 123/90.17; 123/90.31

(58) Field of Classification Search ..... 123/90.15, 123/90.16, 90.17, 90.31
See application file for complete search history.

(56) References Cited

U.S. PATENT DOCUMENTS

| | | | | |
|---|---|---|---|---|
| 5,738,056 | A | 4/1998 | Mikame et al. | |
| 6,209,516 | B1 * | 4/2001 | Yamashita | 123/305 |
| 6,213,103 | B1 * | 4/2001 | Kalla et al. | 123/549 |
| 6,705,257 | B2 * | 3/2004 | Shimizu | 123/90.15 |
| 6,920,851 | B2 | 7/2005 | Machida et al. | |
| 6,981,478 | B2 * | 1/2006 | Schafer et al. | 123/90.17 |
| 2002/0043243 | A1 * | 4/2002 | Majima | 123/399 |
| 2005/0217620 | A1 * | 10/2005 | Shindou | 123/90.15 |

FOREIGN PATENT DOCUMENTS

| | | |
|---|---|---|
| JP | 1-315631 | 12/1989 |
| JP | 3211713 | 7/2001 |
| JP | 2004-76618 | 3/2004 |
| KR | 10-0242589 | 11/1999 |

OTHER PUBLICATIONS

Akasaka et al., "Gasoline Engine: Recent Trends in Variable Valve Actuation Technologies to Reduce the Emission and Improve Fuel Economy," *Automotive Engineering*, vol. 59, No. 2, 2005, pp. 33-38.

* cited by examiner

*Primary Examiner*—Zelalem Eshete
(74) *Attorney, Agent, or Firm*—Foley & Lardner LLP

(57) ABSTRACT

In a variably operated valve system for a compression ignition engine, an adjustment mechanism is controlled by means of a control section to detach an intake valve closure timing from a bottom dead center in accordance with an engine driving condition, and an engine start securing section guarantees an engine start even at least one of cases during a failure in the control section, during a stop of the engine, and during a start of the engine.

19 Claims, 14 Drawing Sheets

MOST ADVANCE ANGLE POSITION

MOST RETARDATION ANGLE POSITION

VARIABLY OPERATED VALVE SYSTEM FOR COMPRESSION IGNITION ENGINE

BACKGROUND OF THE INVENTION

The present invention relates to a variably operated valve system for an intake valve or an exhaust valve of a reciprocating engine and, more particularly, relates to the variably operated valve system suitable for use in a compression ignition engine such as a four-stroke and two-stroke Diesel engine.

Recently, a variably operated valve system which varies a lift and open and closure timings of the intake valve(s) and/or the exhaust valve(s) in accordance with an engine driving condition has widely been utilized in order to control a charge efficiency of the engine, an effective compression ratio, and a residual gas quantity and to improve an engine performance and an emission performance. In a Diesel engine or a premixture compression ignition engine, due to a temperature rise of gas generated along with a compression stroke of the engine, an injected fuel is self ignited. The self-ignition of fuel is carried out only under such a condition that an in-cylinder temperature is high and a pressure is high. Although the self-ignition is dependent on a kind of fuel, the self-ignition is not carried out unless the temperature is equal to or higher than 1000 K and the pressure is equal to or higher than 1 MPa. Hence, during a low temperature start of the engine (so-called, a cold start), a temperature of a cylinder wall is low and a cylinder is deprived of a heat of gas. Unless a compression ratio is increased to be equal to or higher than, for example, 15 to increase the gas temperature and pressure within the cylinder, the self-ignition is not developed and a combustion of fuel cannot be achieved. However, at a time point at which a warm-up of the engine is completed, the high compression ratio causes the pressure acted upon a cylinder piston to be increased. Thus, a mechanical friction loss is increased and the engine performance is easy to be reduced. In order to avoid this, after the completion of the engine start, it has been proposed that the compression ratio is reduced to be equal to or lower than 15 to improve the engine performance. After the engine start, the temperature on the cylinder wall becomes higher. Even if the compression ratio is low, the cylinder is not deprived of the gas heat. Hence, the gas temperature and pressure become high and the self-ignition is carried out. The variation in the compression ratio is, as well known, carried out by mechanically changing a clearance volume of the piston or by mechanically changing a piston stroke. However, these mechanisms become complex. Wheread, a valve closure timing of the intake valve (or intake valves per cylinder) is retarded or advanced with respect to a crank angle so that a gas mass at a time of a compression stroke start can be varied. Rises in the gas pressure and temperature with respect to the crank angle can be retarded. That is to say, the effective compression ratio can be reduced. A previously proposed variably operated valve system is exemplified by a Japanese Patent Application First Publication No. Heisei 1-315631 published on Dec. 20, 1989 in which, in a two-stroke Diesel engine, an electrically driven variably operated apparatus (can twist type) makes an intake valve closure timing (IVC) approach to a bottom dead center (BDC) to increase the effective compression ratio. Thereby, the self-ignition during the engine start is assured and makes IVC (intake valve closure) retard during an ordinary driving so that the effective compression ratio is reduced and a fuel economy is reduced. In addition, another previously proposed variably operated valve mechanism is included in a rotary vane operated by means of a hydraulic as disclosed in a Japanese paper titled Recent trends in variable valve actuation technologies to reduce the emission and improve the fuel economy, pages 33 to 38 of Automotive Technology vol. 59, No. 2 by Yuuzou AKASAKA and Hajime MIURA.

SUMMARY OF THE INVENTION

However, in a case where, in each of the previously proposed variably operated systems described above, a mechanical failure such as a failure in an electrical system of a hydraulic switching valve or a fixation (lock) of the hydraulic switching valve occurs or a failure in a hydraulic system thereof occurs, the intake valve closure timing (IVC) is separated (detached or varied) from a bottom dead center (BDC) position during the engine start so that the effective compression ratio is not sufficiently raised and a start failure may occur. Even in a case of an electrical power drive variably operated valve system, such a failure as a short-circuiting of a motor or a drop in a battery voltage occurs, the IVC is separated (detached) from the BDC so that the self-ignition may not occur and a start failure may occur.

It is, therefore, an object of the present invention to provide variably operated valve system for a compression ignition engine which can solve inconveniences during the start of the engine such that the intake valve closure timing (IVC) is separated (detached) from the bottom dead center (BDC) so that the self-ignition may not occur and the start failure may occur. In the previously proposed variably operated valve system disclosed in the above-described Japanese Patent Application Publication, a phase adjustment mechanism (VTC, Valve Timing Control mechanism) using a stepping motor. When a current flowing through the stepping motor is turned to OFF, in a case where the phase adjustment mechanism operates normally, the IVC is automatically reached to a position near to the BDC (20 degrees after the bottom dead center (BDC) in the crank angle (CA)). If a current flowing through the stepping motor is turned to ON, the IVC is controlled to be approached to a position retarded from the BDC (60 degrees after the bottom dead center (BDC) in the crank angle). However, in a case where a rotary axle of the stepping motor is fixed (locked), the phase adjustment mechanism is fixed at the position at which the phase adjustment mechanism is fixed. Even if the current flowing through the stepping motor is turned off, the IVC cannot be set to the position near to the BDC. Hence, during the start of the engine, the IVC is set to the position near to the BDC. After the engine start, the IVC is retarded. However, if the stepping motor is fixed, the inconveniences during the start of the engine cannot be solved In addition, in the latter Japanese Paper, various variably operated valve systems have been proposed. The adjustment mechanism which varies the phase (VTC) and another adjustment mechanism which varies a lift (lift quantity) are directly driven by means of an electric control section (electric motor and electromagnet) operated in response to an output electrical signal of an electronics control unit (ECU) Or alternately, the hydraulic power section which is operated by the electric control section is indirectly driven. In each of examples of the variably operated valve systems, in a case where the control section has failed in the same way as that disclosed in the former Japanese Patent Application First Publication, such means as acting the IVC to approach to the position near the BDC is not provided. Thus, the inconveniences during the start of the engine cannot still be solved.

To achieve the above-described object, according to one aspect of the present invention, there is provided with a variably operated valve system for a compression ignition engine, an adjustment mechanism that is controlled by means of a control section to detach an intake valve closure timing from a bottom dead center in accordance with an engine driving condition; and an engine start securing section that guarantees an engine start even at least one of cases during a failure in the control section, during a stop of the engine, and during a start of the engine.

It is noted that the IVC described in the specification can be defined as the intake valve closure timing as described above but is not a timing that the intake valve is completely closed but may be the timing at which an effective lift interval not including a ramp interval not including a ramp interval is completed. If the effective closure timing is set in the proximity to the BDC, a substantial closure timing at which a lift acceleration interval is completed can be deemed to the BDC and, thus, the effective compression ratio can more substantially be increased. In the variably operated valve system for the compression ignition engine according to the present invention including the control section to control the IVC to be detached from the BDC (bottom dead center) in accordance with the engine driving condition, even if the control section has failed, the mechanical bias section always sets the IVC to be in a state near to the BDC. Hence, the effective compression ratio can be maintained at a highest level that the engine is provided and the reliability of the engine start can remarkably be increased. Furthermore, eve if the mechanical bias section cannot set the IVC to be in the proximity to the BDC due to an inconvenience in the control section, the startability (start characteristic) guarantee fail-safe control logic can assuredly start the engine.

This summary of the invention does not necessarily describe all necessary features so that the present invention may also be a sub-combination of these described features.

DETAILED DESCRIPTION OF THE INVENTION

Figure 1:
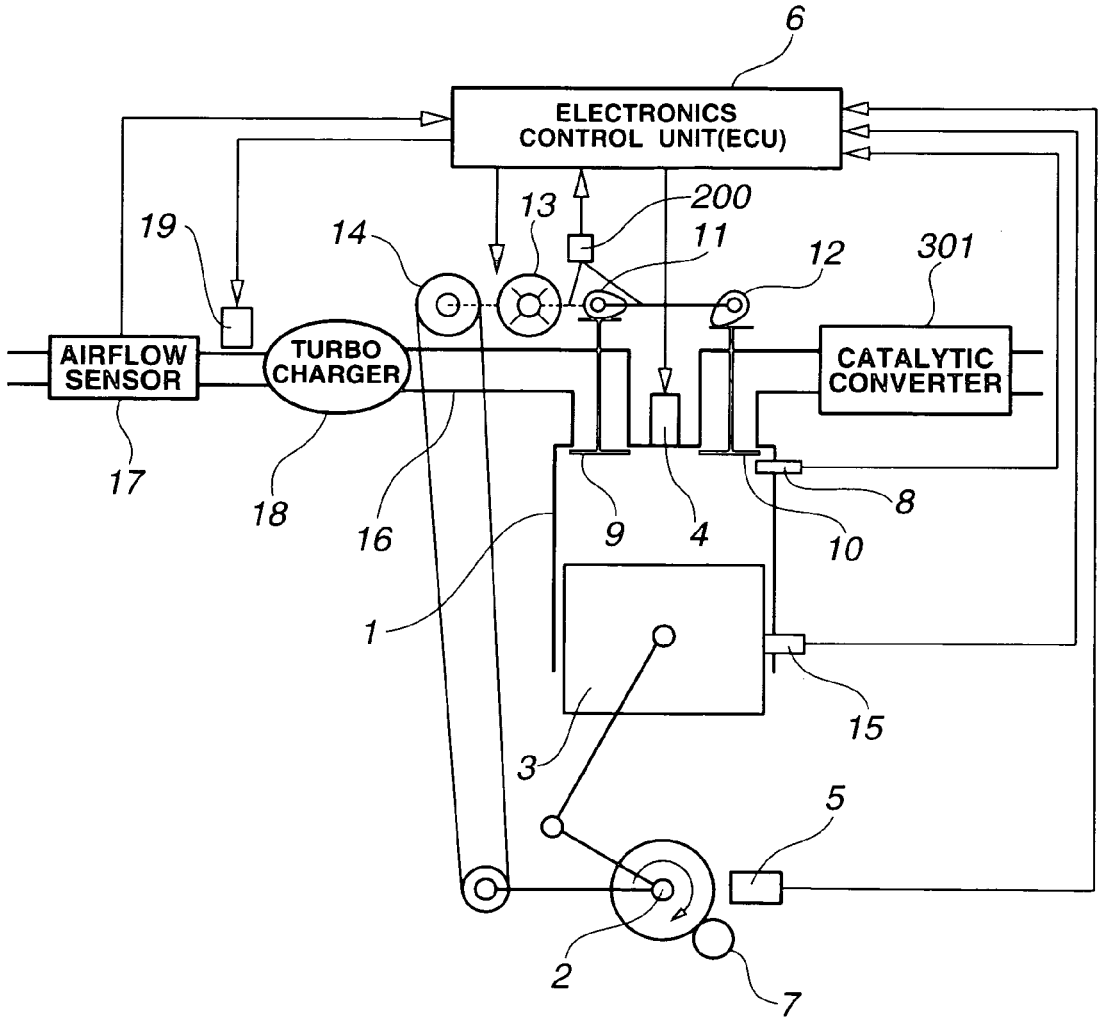
FIG. 1 is a configuration view of a variably operated valve system in a preferred embodiment according to the present invention.

Reference will hereinafter be made to the drawings in order to facilitate a better understanding of the present invention.

First, a variably operated valve system of a four-stroke Diesel engine will be described with reference to FIG. 1. A crankshaft 2 of an engine 1 is revolved in a clockwise direction as viewed from FIG. 1. A state in which a cylinder piston 3 is located at a bottom position (lowest position) indicates a bottom dead center (BDC) which is represented in 180 degrees in crank angle (CA). When crankshaft 2 is revolved and piston 2 has reached to a top dead center (a highest position as viewed from FIG. 1), it indicates a top dead center (TDC) and its crank angle (CA) is expressed to be 360 degrees. In a case of an ordinary Diesel combustion, fuel is injected within a cylinder from a fuel injection valve 4 and a self-ignition due to a high temperature of gas occurs and fuel is combusted. In a case of a pre-mixture compression ignition, fuel is injected from fuel injection valve 4 in a suction stroke, the injected fuel being sufficiently mixed with a charged air of the cylinder. When piston 3 is raised, temperature and pressure of the pre-mixed air within the cylinder are raised, the fuel mixture of air is self-ignited and combusted. A fuel injection timing of fuel injection valve 4 is in accordance with a signal from crank angle sensor 5 and is controlled by means of an electronics control unit (ECU) 6. In addition, during a start of engine 1, a starter 7 is coupled to a crankshaft 2 and crankshaft 2 is accordingly revolved. Furthermore, during the start of engine 1, a current is caused to flow through a glow plug 8 to raise the temperature of glow plug 8. Thus, an evaporation of fuel is promoted to support the self-ignition of air mixture of fuel. An exhaust gas is purified by means of a catalytic converter 301.

An intake valve 9 and an exhaust valve 10 are disposed on an upper portion of engine 1 and are driven by means of an intake cam 11 and an exhaust cam 12, respectively. Intake cam 11 is connected to a cam axle timing pulley 14 via a variably operated valve mechanism (VTC (a variable timing control mechanism) 13 of a lift phase variable type. The revolution of crankshaft 2 is transmitted to cam axle timing pulley 14 via a timing belt or a timing pulley. A signal from a water (coolant) temperature sensor 15 is inputted to an ECU (Electronics Control Unit) 6. A signal from VTC phase difference position sensor 200 is also inputted to ECU 6. When crankshaft 2 is revolved, cam axle timing pulley 14 is also revolved at ½ the revolution of crankshaft 2. Intake cam 11 is revolved and the open operation of intake valve 9 is carried out once per revolution of crankshaft 2 and the air is sucked to the cylinder. In addition, when cam axle timing pulley 14 is revolved, an exhaust cam 12 connected thereto is revolved. Thus, an open operation of exhaust valve 12 is carried out per two revolutions of crankshaft 2 and the air is sucked into the cylinder. An airflow sensor 17 to measure an intake air quantity, a turbo charger 18, and an exhaust gas recirculation valve (EGR) 19 are disposed in an intake system 16 located at an upstream position of intake valve 9.

Figure 2:
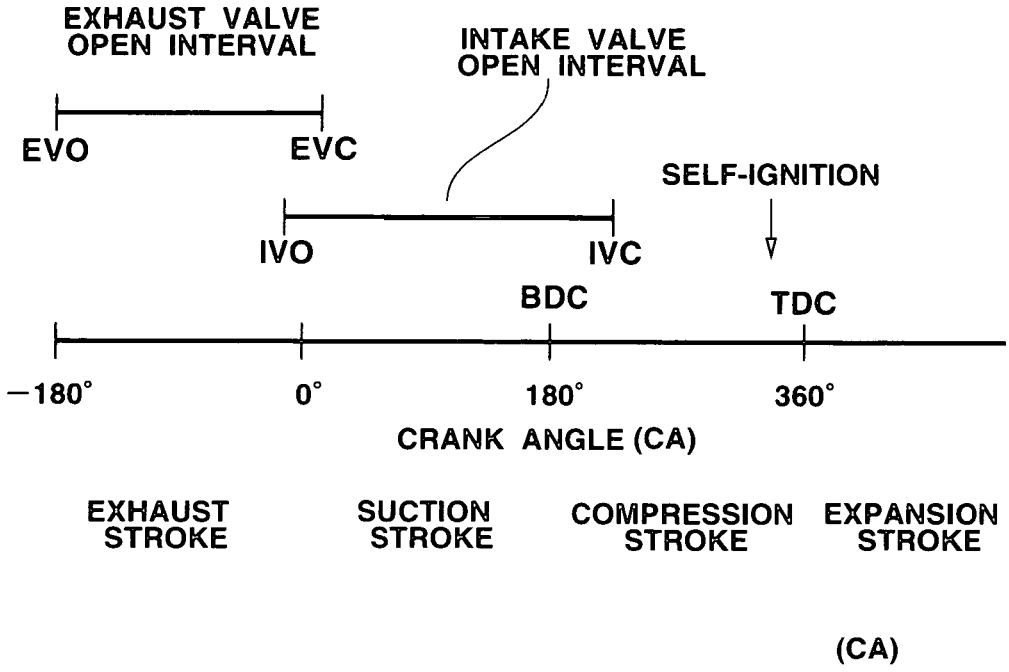
FIG. 2 is a characteristic graph for explaining operations in a case of four-stroke engine in the variably operated valve system in the embodiment shown in FIG. 1.

FIG. 2 shows open-and-closure timings of intake valve 9 and exhaust valve 10 in the ordinary four-stroke Diesel engine shown in FIG. 1. Exhaust valve 10 is opened at a beginning of an exhaust stroke at a crank angle (CA) of (minus) 180 degrees. This timing is called EVO (Exhaust Valve Open timing). Exhaust valve 10 is closed at a timing at which the exhaust stroke is ended. This timing is called EVC (Exhaust Valve Closure timing). Intake valve 10 is opened at a position near to crank angle of 0 degrees at a beginning of the intake stroke and closed in a proximity to the BDC which corresponds to an end of the suction stroke. The former timing is called IVO (Intake Valve Open timing) and the latter timing is called IVC (Intake Valve Closure timing). The self-ignition occurs at a position before the TDC (Top Dead Center) at a time of about an end of a compression stroke. If the IVC is set to be made earlier than the BDC (more advance angle than the BDC), a quantity of gas charged into the cylinder is reduced and the effective compression ratio is reduced. In addition, if the IVC is later (retarded) than the BDC (Bottom Dead Center), the gas charged into the cylinder is again returned to intake system 16, a mass of charged gas within the cylinder is reduced, and the effective compression ratio is reduced.

Figure 3:
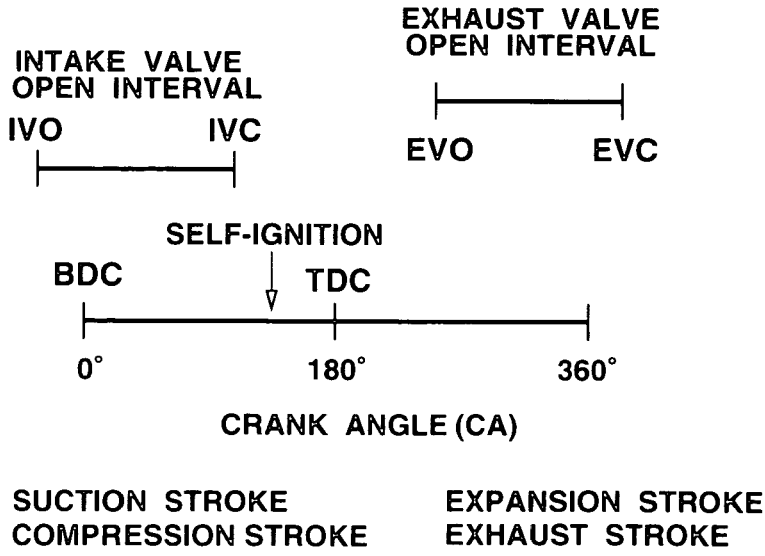
FIG. 3 is a characteristic graph for explaining operations in a case of two-stroke engine in the variably operated valve system in the embodiment shown in FIG. 1.
Figure 4:
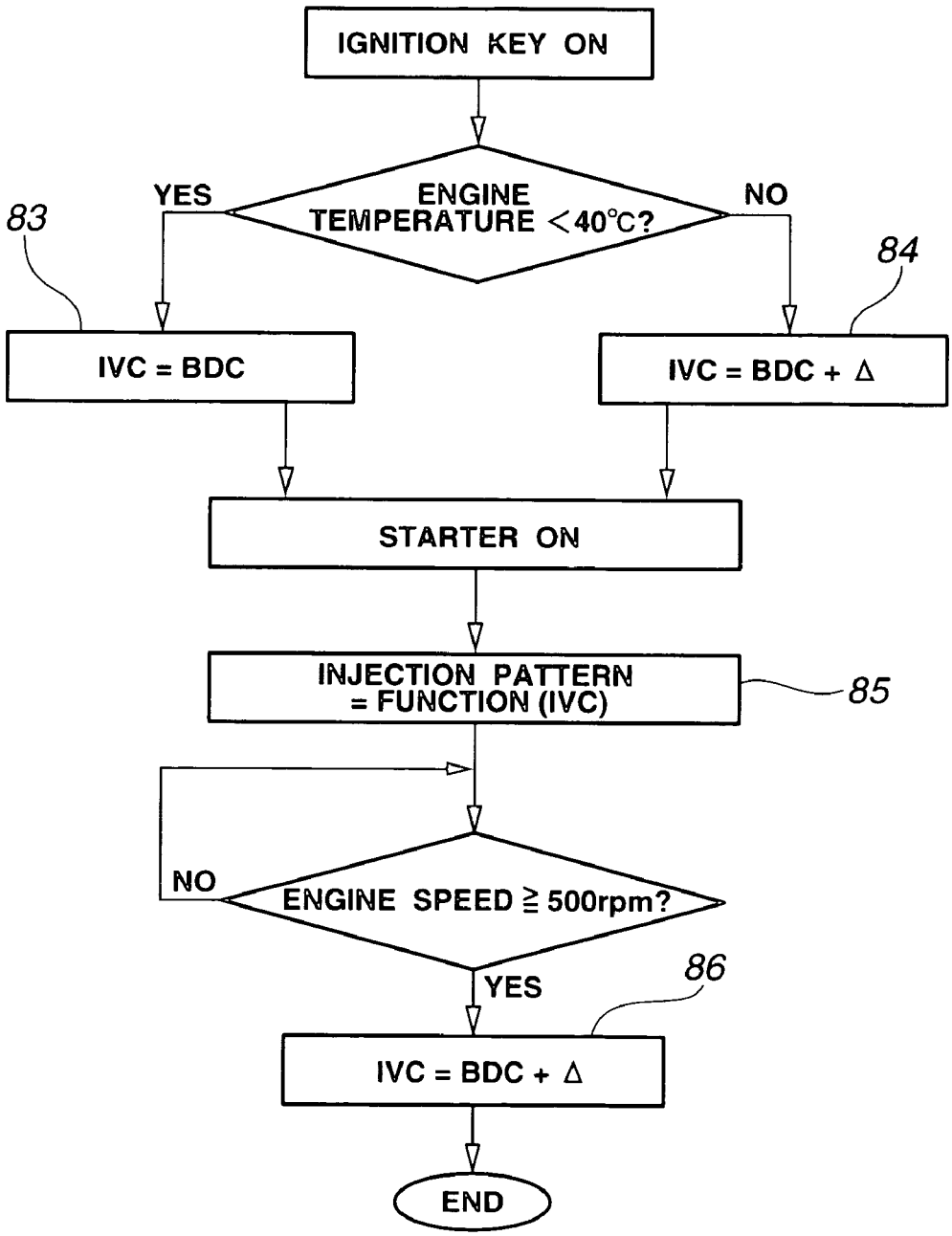
FIG. 4 is a flowchart representing a control flow during a start of engine 1 used in the variably operated valve system in the embodiment shown in FIG. 1.
Figure 5:
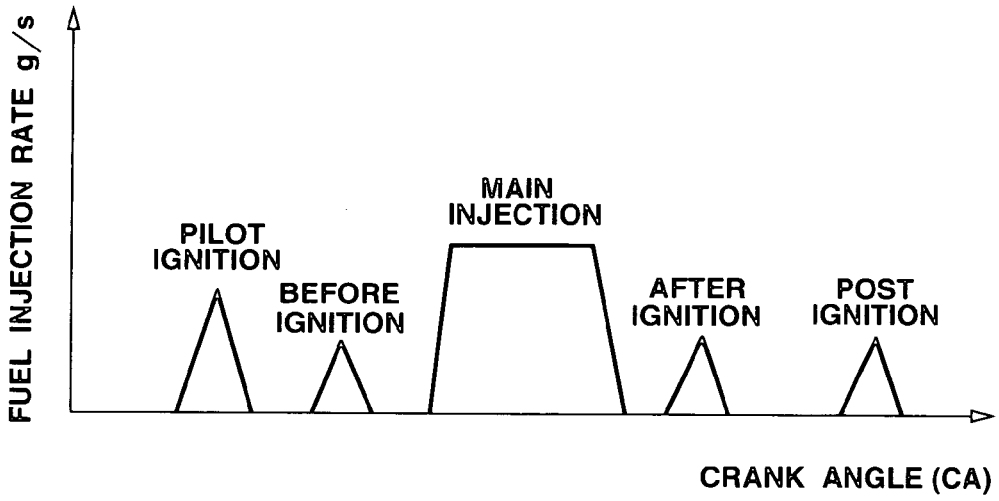
FIG. 5 is an explanatory view of a fuel injection pattern used in the variably operated valve system in the embodiment shown in FIG. 1.

In a case of a two-stroke engine, one cycle is ended through 360 degrees (one revolution), as shown in FIG. 3. Hence, during the crank angle of 180 degrees, the suction stroke and the compression stroke corresponding to four strokes are carried out. At the next 180 degrees, expansion stroke and exhaust stroke are carried out. The self-ignition is carried out before the TDC. Since open operations of intake and exhaust valves 9 and 10 are carried out once for one revolution, cam axle timing pulley 14 is driven at the same revolution speed as crankshaft 2 as shown in FIG. 1. The elements in the case of the four-stroke engine are applicable to the other elements in the case of the two-stroke engine. If the IVC approaches to the BDC, the air mixture fuel is compressed in a state in which the mass of gas is many and the effective compression ratio becomes higher. In addition, if the IVC is retarded with respect to the BDC, the quantity of gas charged in the engine cylinder is reduced and the effective compression ratio is reduced in a case where the pressure in intake system 16 is constant. FIG. 4 shows a control operation of ECU 6 when the engine start is performed. When engine 1 is started, namely, when an engine speed derived from a signal of crank angle sensor 5 is zeroed or when an engine temperature derived from a signal outputted by coolant (water) temperature sensor 15 is lower than 40°, control unit (ECU) 6 determines that engine 1 is in a low temperature start (cold start) and drives engine 1 in a mode in which the IVC becomes in a state near to the BDC and the effective compression ratio is made high. When a revolution speed of engine 1 is equal to or higher than 500 rpm, control unit (ECU) 6 determines that the engine start is completed and the IVC is retarded by a phase angle Δ than the BDC. In the case of the four-stroke engine, the effective compression ratio can be reduced with the IVC made advanced than the BDC. In the case of the engine stop, a case where the IVC is set to the BDC and a case where, at the same time of an ignition switch key on, the IVC is controlled to be reached to the BDC are supposed. Hence, at steps 83, 84, and 86 in FIG. 4, a detection and a control of phase angle A are carried out with the signal of VTC phase sensor 200 based. In a case where the IVC is already set to the BDC during the engine stop, the position of the IVC is only checked at step 83 in FIG. 4 and a starter on is directly entered. When the engine revolution is raised, the IVC is retarded by only phase angle Δ at step 86. In a case where the IVC is not set to the BDC during the engine stop, the control operation such that the IVC is made approximately equal to BDC is carried out at step 83. The mass of fuel injected through fuel injection valve 4 is controlled in accordance with the signals indicating the flow quantity of intake air from airflow sensor 17 and the revolution signal of engine 1. In addition, with the states of exhaust gas recirculation (EGR) valve 19 and turbocharger 18 taken into consideration, the mass of fuel and the timing of the fuel injection are determined. It is natural that a variation of the IVC of intake valve 9 causes the fuel injection quantity (mass of fuel) and the fuel injection timing to be needed to be modified. Therefore, the signal of VTC phase sensor 200 is inputted to ECU 6. The fuel injection quantity is modified according to the phase of VTC, namely, the position of IVC. As shown in FIG. 5, during the injection of one stroke of the Diesel engine, the fuel is injected by dividing the fuel injection into pilot, prior, main, sub, and post injections. This injection pattern is varied according to the driving state. This injection pattern is varied according to the driving state. At a step 85 in the flowchart of FIG. 4, the fuel injection pattern is given as the function of the IVC. The variation of the IVC is reflected immediately on the fuel injection pattern (fuel injection quantity and the number of times the fuel is injected).

Figure 6:
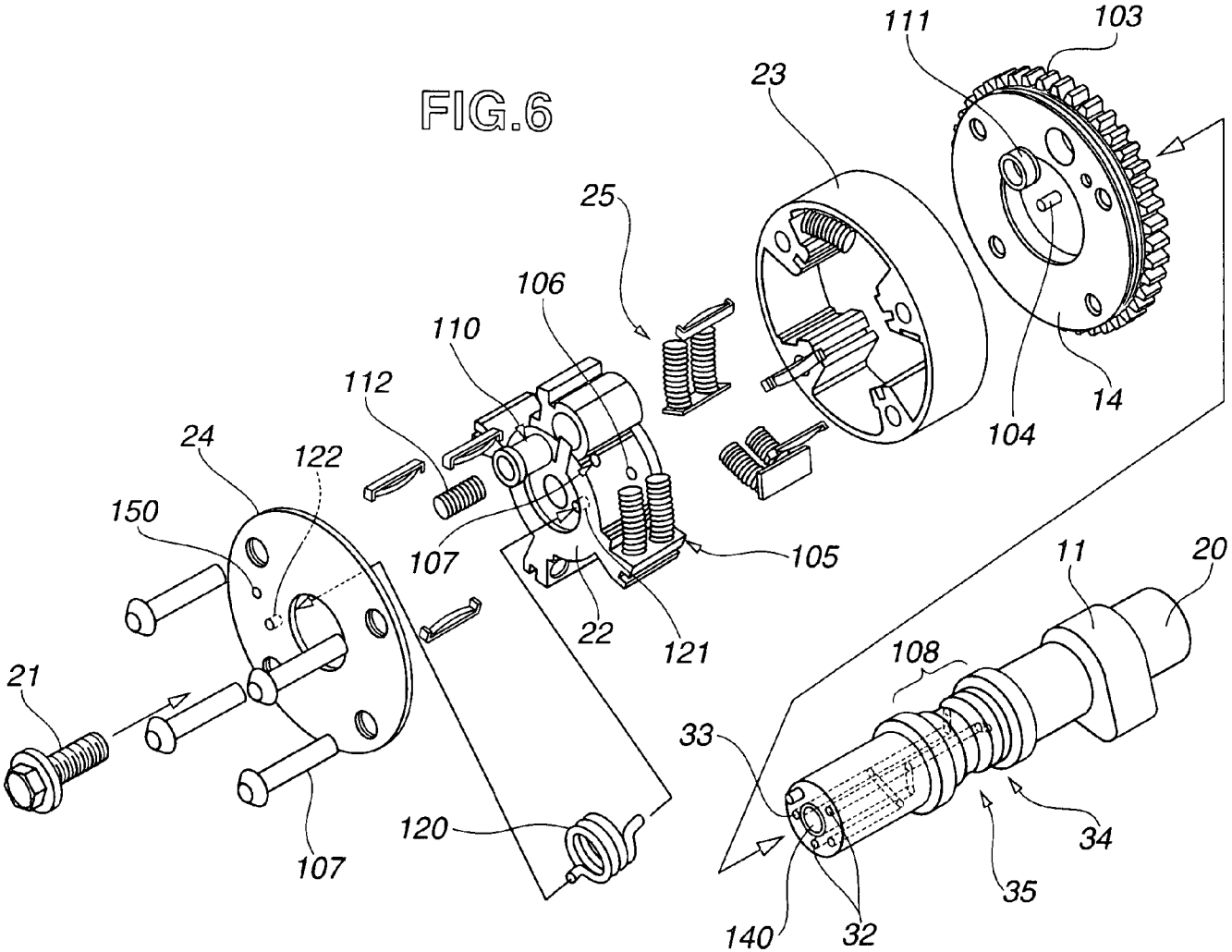
FIG. 6 is an exploded perspective view of a phase adjustment mechanism for an intake valve in the variably operated valve system in the embodiment shown in FIG. 1.

FIG. 6 shows an exploded perspective view of the intake valve VTC (Variable Timing Control mechanism) executed at steps 83, 84, and 86 in FIG. 4 described above. This VTC is of an electrical hydraulic type. Intake cam axle 20 onto which intake cam 11 is attached is fixed to a hydraulic vane main frame 22 by means of a center bolt 21. A cam axle timing pulley 14 is fixed to a hydraulic housing 23. Hydraulic vane main frame 22 is housed within a hydraulic housing 23 and sealed by means of a front cover 24. Four vanes are installed within hydraulic vane main frame 22. By applying the hydraulic pressure to one side surfaces of the respective vanes, the phases of hydraulic vane main frame 22 and hydraulic housing 23 can be varied within hydraulic housing 23. The IVC can be varied during the driving of the engine according to a phase difference of hydraulic main frame 22 and hydraulic housing 23. In this case, the IVO can simultaneously be varied.

A total of eight, four positioned, two rows bias springs 25 are arranged between side surfaces (four positions) of the vane portions and stopper surfaces (four positions) of hydraulic housing 23. These bias springs 25 bias hydraulic vane main frame 22 in a clockwise direction, namely, in a direction that cam axle 20 advances. Front cover 24 is fixed to hydraulic housing 23 by means of four fixing bolts 107. An inspiration hole 150 is provided on front cover 24. In FIGS. 6, 7A, 7B, and 7C, oil is supplied into advance angle hydraulic chambers 30 and retardation angle hydraulic chambers 31 via advance angle hydraulic passages 32, retardation angle hydraulic passages 33, an advance angle hydraulic hole 106, and a retardation angle hydraulic hole 107. This advance angle hydraulic passages 32 and retardation angle hydraulic passages 33 are arranged within intake cam axle 20 shown in FIG. 6. Oil (lubricating oil) is supplied from an external by means of an oil pump which supplies lubricating oil to engine 1 via an advance angle hydraulic groove 34 and a retardation angle hydraulic groove 35. Advance angle hydraulic groove 34 and retardation angle hydraulic groove 35 are arranged within a portion of a cam journal bearing 108. A center bolt tightening screw hole 140 is disposed on a tip of intake cam axle 20. This hydraulic piston 110 can be fitted into a seat 111 of cam axle timing pulley 14. When hydraulic piston 110 is fitted into seat 111, vane main frame 22 is fixed to cam axle timing pulley 14 and takes the same operation as cam axle timing pulley 14. When the hydraulic acted upon vane main frame 22 is not sufficient during, for example, the engine start, this fitting operation is carried out so that a vibration of vane main frame 22 can be prevented. This position of this fitting is set at a position such that this IVC is approximately equal to the BDC as shown in FIG. 6. When engine 1 starts the revolution, the hydraulic acted upon vane main frame 22 becomes higher. At this time, hydraulic piston 110 is moved toward a direction at which the fitting is released against piston return spring 112 by means of oil supplied from advance angle hydraulic hole 106 and retardation angle hydraulic hole 107. This releases the connection between vane main frame 22 and cam axle timing pulley 14 so that vane main frame 22 is controlled by an ordinary hydraulic.

Figure 7A:
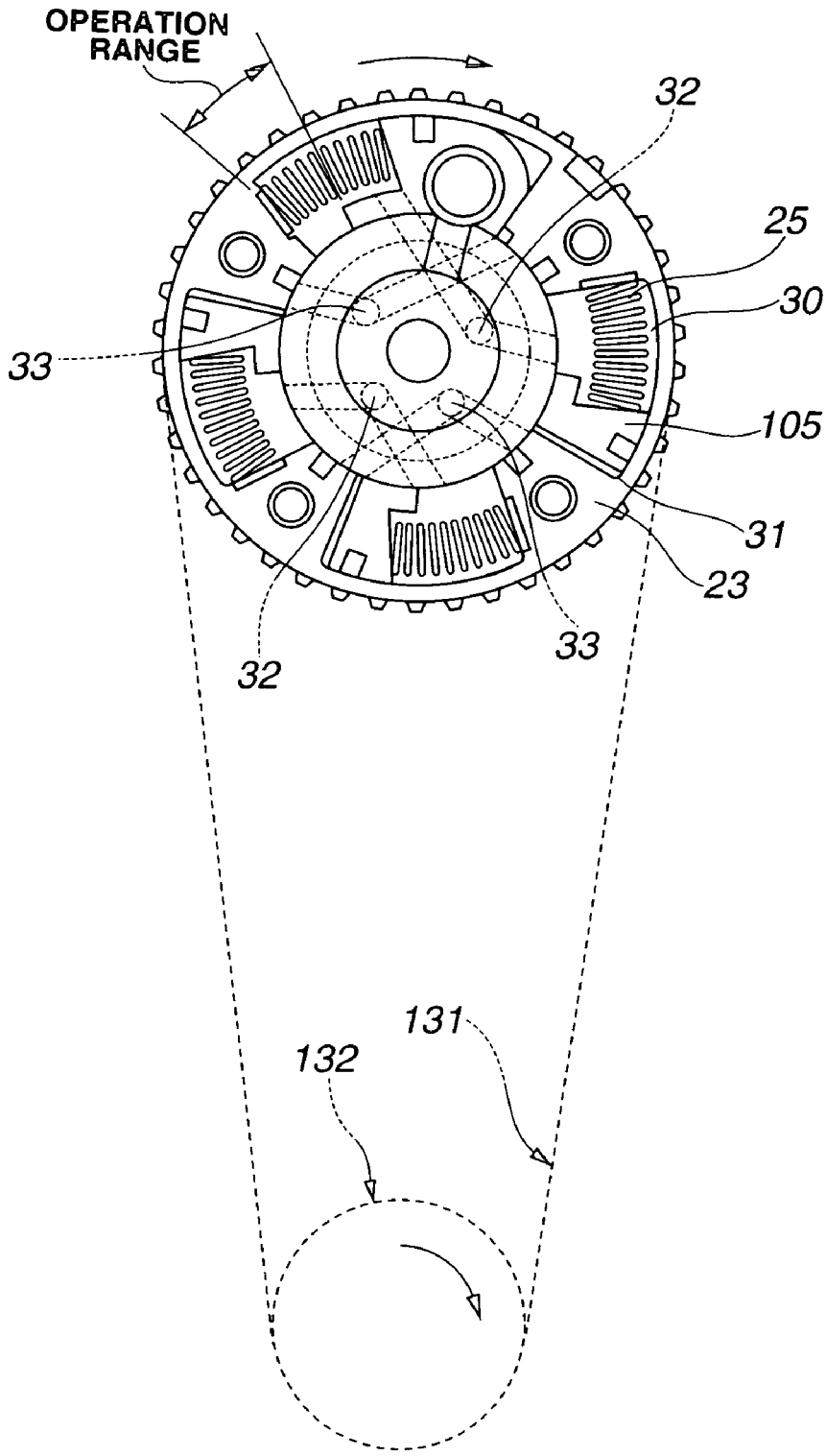
FIG. 7A is an explanatory view representing an advance angle position related to the configuration view of the variably operated valve mechanism shown in FIG. 6.
Figure 7B:
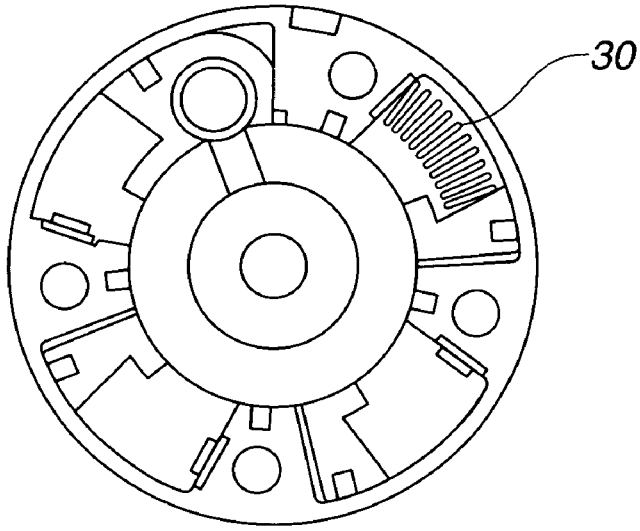
FIG. 7B is an explanatory view representing a most advance angle position related to the configuration view of the variably operated valve mechanism shown in FIG. 6.
Figure 7C:
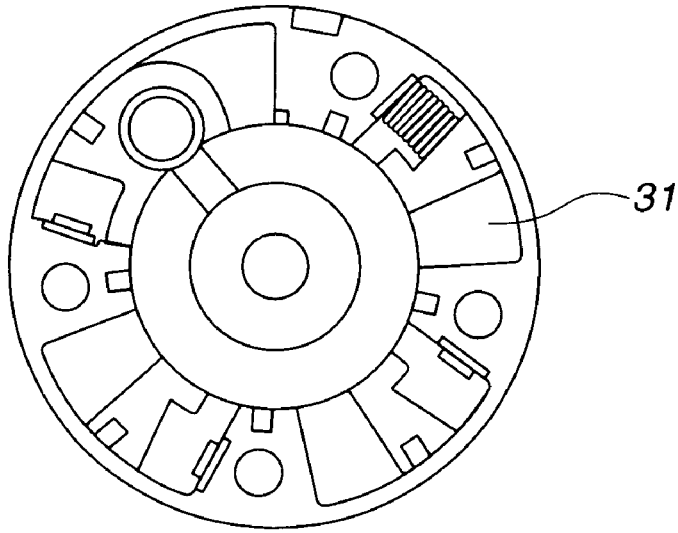
FIG. 7C is an explanatory view representing a most retardation angle position related to the configuration view of the variably operated valve mechanism shown in FIG. 6.

In FIG. 6, a bias twist spring 120 to unite vane main frame 22 with front cover 24 can be added. The position of bias springs 25 arranged within hydraulic housing 23 is different from a position at which bias spring 120 is arranged. Hence, these springs 25, 120 are not actually interfered so that a large biasing force an be developed. As appreciated from FIG. 6, hooks located on both ends of bias twist spring 120 are inserted into a twist spring hook inserting hole 122 installed on front cover 24 and a twist spring hook inserting hole 121 provided on vane main frame 22, respectively. This bias twist spring 120 biases intake cam axle 20 in the clockwise direction, namely, in an advance angle direction. In FIGS. 7A, 7B, and 7C, hydraulic housing 23 is driven by means of engine 1 via crankshaft timing pulley 132 and timing chain 131. In the case of the four-stroke engine, hydraulic housing 23 is revolved at a half revolution per one revolution of crankshaft 2. In the case of the two-stroke engine, hydraulic housing 23 is also revolved at one revolution per one revolution of crankshaft 2. Oil is supplied into advance angle hydraulic chamber 30 and retardation angle hydraulic chamber 31 via advance angle hydraulic passage 32 and retardation angle hydraulic passage 33. At this time, in a case where the hydraulic within advance angle hydraulic chamber 30 is the same as that within retardation angle hydraulic chamber 31 or larger than that within retardation angle hydraulic chamber, the oil is filled within advance angle hydraulic chamber 30. Thus, vane main frame 22 becomes a state shown in FIG. 7B and operations of the IVO and the IVC are carried out at an earlier timing with respect to the revolution (crank angle: CA) of cam axle timing pulley 14 (a most advance angle). In a case where the hydraulic is not acted upon advance angle hydraulic chamber 30 and retardation angle hydraulic chamber 31, bias spring 25 automatically controls the IVO and the IVC at the advance angle position shown in FIG. 7B. On the other hand, in a case where the hydraulic within retardation angle hydraulic chamber 31 is sufficiently higher than that within advance angle hydraulic chamber 30. Oil is filled within retardation angle hydraulic chamber 31 and the state within hydraulic vane main frame 22 is as shown in FIG. 7C. Thus, operations of the IVO and the IVC are such a state where the IVO and the IVC are most retarded (a most retardation angle). Hence, a provision of bias springs 25 on advance angle hydraulic chamber 30 permits an automatic setting of the IVC in the most advance angle state (for example, the BDC) when no hydraulic pressure is acted. As alternatives of bias spring 15, a coil spring of a stretch type and a plate like spring are included. In addition, bias twist spring 120 can also automatically set the IVC in the most advance angle state (for example, the BDC) when the hydraulic is not acted.

Figure 8A:
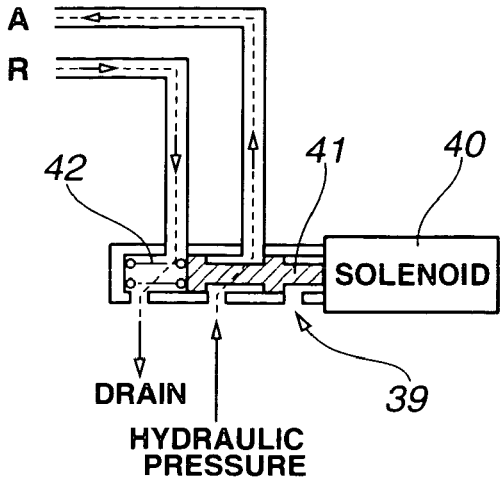
FIGS. 8A, 8B, and 8C are systematic views of a hydraulic system in the embodiment of the variably operated valve system shown in FIG. 1.
Figure 8B:
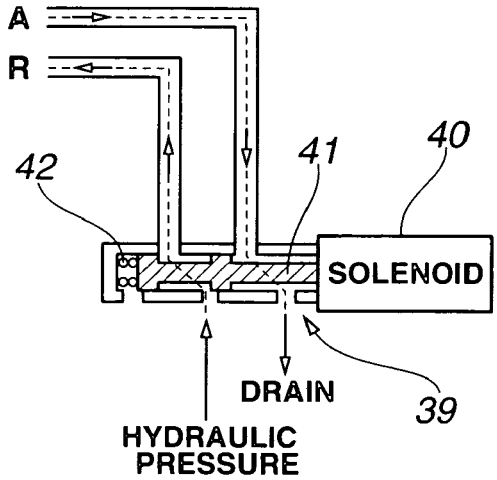
Figure 8C:
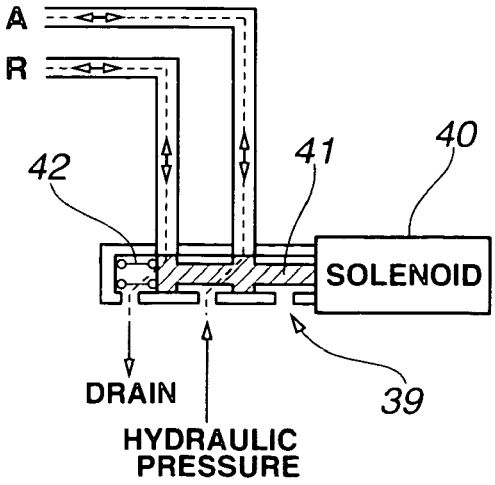

A flow of oil described above is controlled by means of an oil control valve 39 shown in FIGS. 8A, 8B, and 8C. Oil control valve 39 includes a solenoid portion 40, a spool portion 41, and spool bias spring 42. In FIGS. 8A, 8B, and 8C, a symbol A is connected to advance angle hydraulic passages 32 and a symbol R is connected to retardation angle hydraulic passages 33. A signal from ECU 6 shown in FIG. 1 is inputted to solenoid portion 40. In FIGS. 8A, when spool portion 41 is placed in response to the signal from ECU 6 as shown in FIG. 8A, the hydraulic pressure in advance angle hydraulic passages 32 becomes higher and the pressure within retardation angle hydraulic passages 33 is reduced. Hence, vane main frame 22 is moved toward the advance angle side. Spool portion 41 is in the state shown in FIG. 8A as a de facto (stable position) state. Hence, the de facto state of the IVC is the BDC (most advance angle). That is to say, the IVC is made approximately equal to the BDC. When spool portion 41 is in a state shown in FIG. 8B against spool bias spring 42, the pressure of advance angle hydraulic passage 32 is reduced and the hydraulic of retardation angle hydraulic passage 33 is increased so that vane main frame 22 is revolved in the retardation angle side. As shown in FIG. 8C, when spool portion 41 is held at an intermediate position, advance angle hydraulic passages 32 and retardation angle hydraulic passages 33 are closed. Vane main frame 22 is held at a predetermined position. That is to say, the IVC is held at an arbitrary position between the most retardation angle state and the most advance angle state. These controls are closed loop control by means of ECU 6 on the basis of an output of the VTC phase sensor 200.

Figure 9:
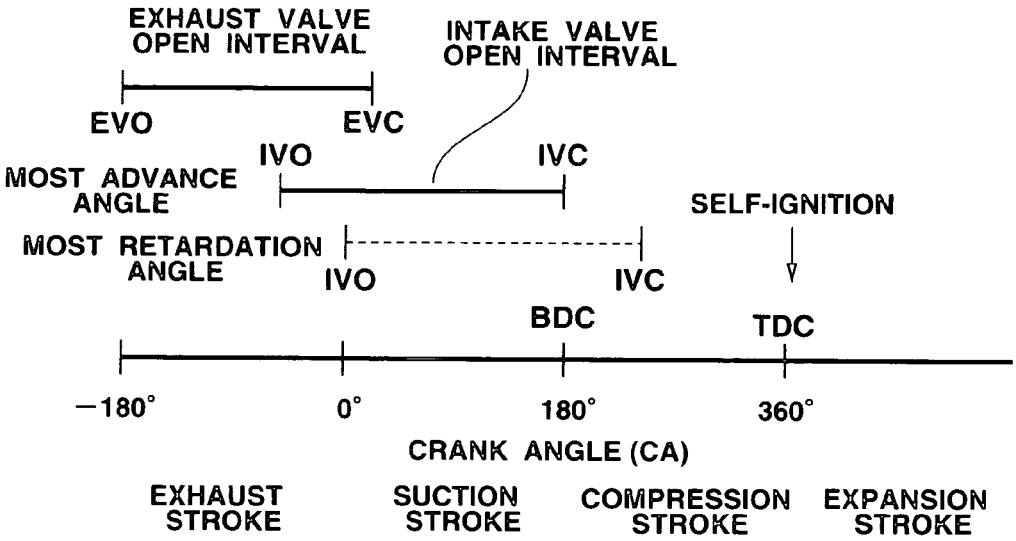
FIG. 9 is a characteristic graph representing an advance angle side of intake valve(s) used in the embodiment of the variably operated valve system shown in FIG. 1.

As described above, solenoid portion 40 of oil control valve 39 controls a position of spool 41. Thus, as shown in FIG. 9, an open interval of intake valve 9 can be controlled in a state of the most advance angle position in which the IVC is approached to the BDC to a state of the most retardation angle position in which the IVC is retarded than the BDC (approximately 40 degrees in the crank angle). At this time, the IVO is simultaneously varied. By making the IVC approach to the BDC, the effective compression ratio is reduced and a mechanical friction loss of engine 1 is reduced. Thus, a fuel consumption after the engine start can be reduced. Furthermore, the reduction of the effective compression ratio permits a suppression of an excessive rise in a combustion temperature. Thus, an NOx emission can be reduced. In the above-described embodiment, in the de facto state, spool portion bias spring 42 causes retardation angle hydraulic passages 33 to open to the atmospheric pressure. Hence, bias springs 25 causes hydraulic vane main frame 22 to be in the most advance state in the de facto state. Hence, during the stop of engine 1, the most advance angle state can automatically be set, namely, in the state wherein the IVC is approximately equal to the BDC. It becomes possible for engine 1 to be started with the compression ratio being high. Therefore, a reliability of the engine start can remarkably be improved as compared with the case where no mechanical bias section is provided. In a case where solenoid portion 40 fails and no operation of oil control valve 39 can be carried out, the state in which the IVC is approximately equal to the BDC is at minimum secured. Hence, although the fuel consumption is increased, engine 1 can stably combust fuel. In a case where no bias section is present, the IVC is not always approximately equal to the BDC and it becomes difficult to guarantee a highly reliable start.

If oil control valve 39 fails, for example, when solenoid portion 40 is not operated due to its fixture onto a wall thereof (so called, sticking of solenoid portion 40 or adherence of solenoid portion 40) and spool portion 41 is in the state of FIG. 8B, the hydraulic tries to cause the IVC to be controlled toward the retardation angle side. However, in this embodiment of the variably operated valve system according to the present invention, bias springs 25 cause vane main frame 22 to be revolved toward the advance angle side so that the IVC is moved toward the advance angle side. Hence, the movement of IVC toward the retardation angle side is avoided so that the IVC is retained at the advance angle side. Hence, the effective compression ratio can be increased and the engine startability (start characteristic) can be assured. Especially, when the hydraulic developed during a cranking of the engine start is set in such a way that a moment to try to move cam axle 20 toward the retardation angle direction is larger than a moment trying to move intake cam axle 20 toward the retardation angle direction. The advantage that an accurate operation can be expected can be raised. Even in a case where oil control valve 39 is in the advance angle state shown in FIG. 8A due to a failure thereof and even in a case where a sufficient hydraulic is not supplied to vane main frame 22 due to a failure in the hydraulic system and a response delay, bias springs 25 forcefully maintain the IVC in the most advance angle state through vane main frame 22 and the start characteristic can be assured. In addition, during the engine start, when the failure of oil control valve 39 causes the hydraulic state to be in a hold control state shown in FIG. 8C. In this embodiment, bias springs 25 acted upon vane main frame 22 cause vane main frame 22 for the IVC to be in the advance state. Hence, the favorable start characteristic can be assured. A torque of each bias spring 25 is set to 2 Nm to 3 Nm which can overcome a variably operated valve moment of intake cam axle 20. A length of each bias spring 25 is, for example, 5 cm and a force thereof is, for example, 1 to 2 Kg. If a furthermore large torque is set, the more advantage can be assured.

Figure 10:
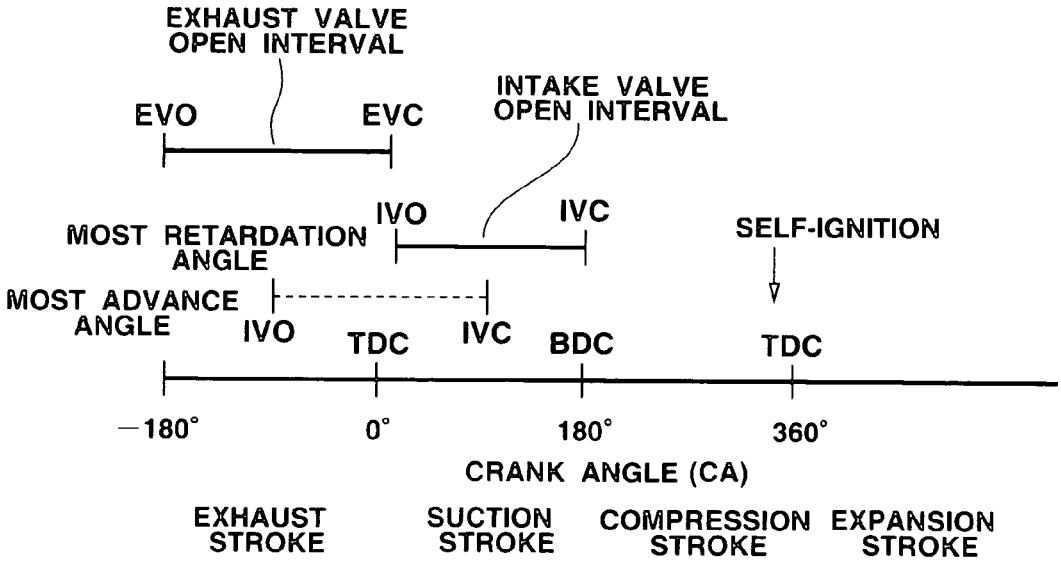
FIG. 10 is a characteristic graph representing a retardation angle side of the intake valve(s) used in a second embodiment of the variably operated valve system according to the present invention.
Figure 11:
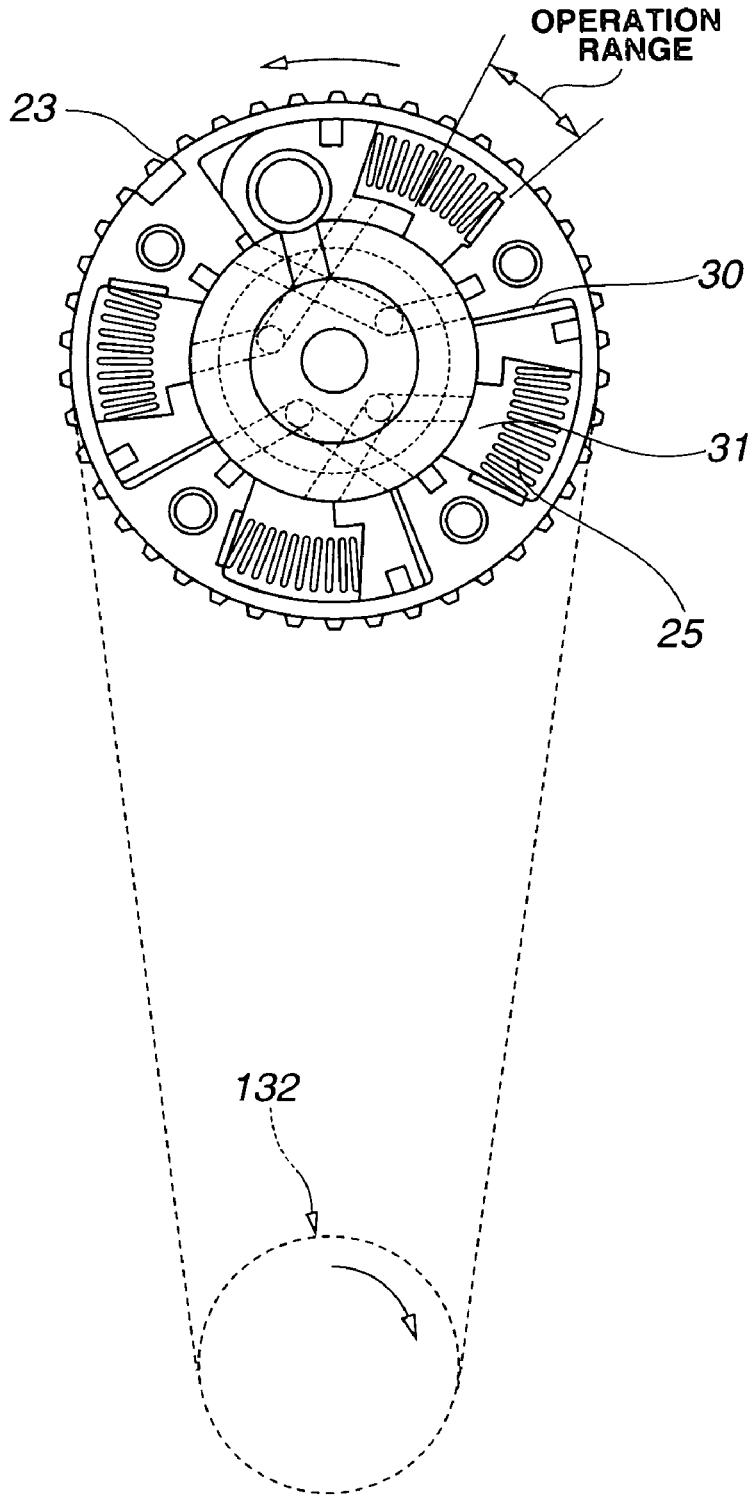
FIG. 11 is a schematic configuration view for explaining an operation of bias springs in the case of the second embodiment of the variably operated valve system shown in FIG. 10.

The effective compression ratio can be reduced even if the IVC is made earlier (more advanced) than the BDC. Since intake valve 9 is closed in a midway through the suction stroke, the charged air quantity is reduced and the effective compression ratio is reduced. FIG. 10 shows timings of the IVO and IVC of intake valve 9 in a case where the above-described principle of operation is utilized to constitute a second embodiment according to the present invention. The IVC in the case of the most retardation angle side approaches to the BDC. The IVC in the case of the most advance angle side is more advanced than the BDC. During the start of engine 1, the IVC is controlled to be approached to the BDC, the effective compression ratio is increased, and the start characteristic can be assured. Upon the end of the start of engine 1, the IVC is controlled to the most advance angle position and the IVC is more advanced than the BDC. Thus, since intake valve 9 is closed during the suction stroke, the mass of charged gas is reduced, the effective compression ratio, the frictional loss becomes reduced, and the fuel consumption is reduced. In this case, since, in the de facto state, the IVC is approximately equal to the BDC, bias springs 25 are, as shown in FIG. 11, mounted in such a way that vane main frame 22 becomes the most retardation angle side in the clockwise direction of vanes. The operations of oil control valves 39 are the same as those in the case of the first embodiment shown in FIGS. 7A through 7C, However, advance angle side hydraulic passage (A) is reversed to retardation angle side hydraulic passage (B). That is to say, during the start of engine 1, the VTC is in the state shown in FIG. 7A and the IVC is approximately equal to the BDC.

At this time, since the IVO is retarded at the timing after the TDC, the air passing through intake valve 9 is quickly drained so that a gas stream is strengthened. Due to a promotion of spraying of fuel, the engine start characteristic can more be strengthened. Upon the completion of the start of engine 1, the operation of control valve 39 causes vane main frame 22 to be controlled in the state of most advance angle state. Thus, the IVC is more advanced than the BDC. Consequently, the effective compression ratio is reduced and the driving of the low fuel consumption becomes possible.

Figure 12:
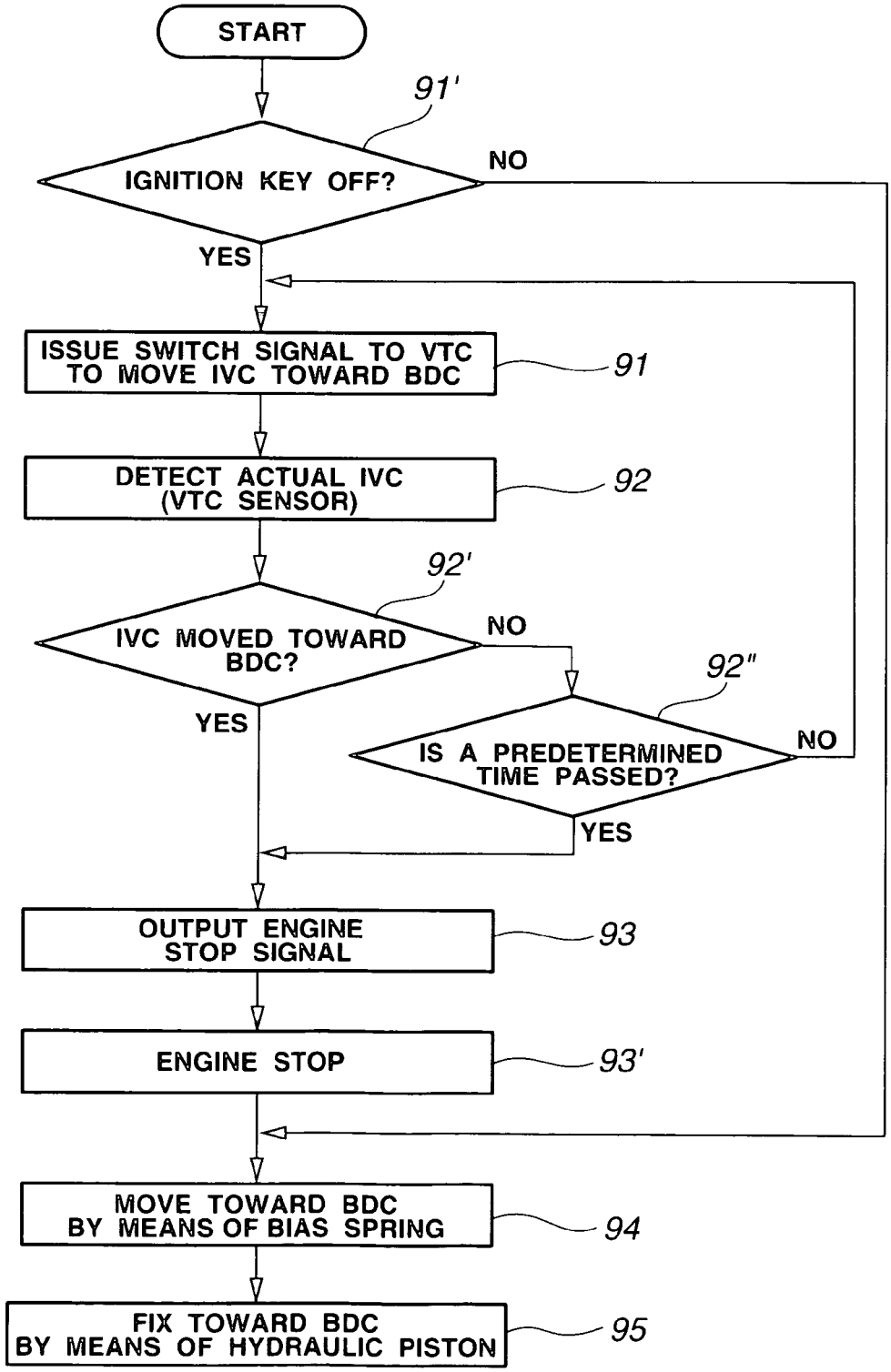
FIG. 12 is a control flowchart during an engine start used in a third preferred embodiment of the variably operated valve system according to the present invention.
Figure 13:
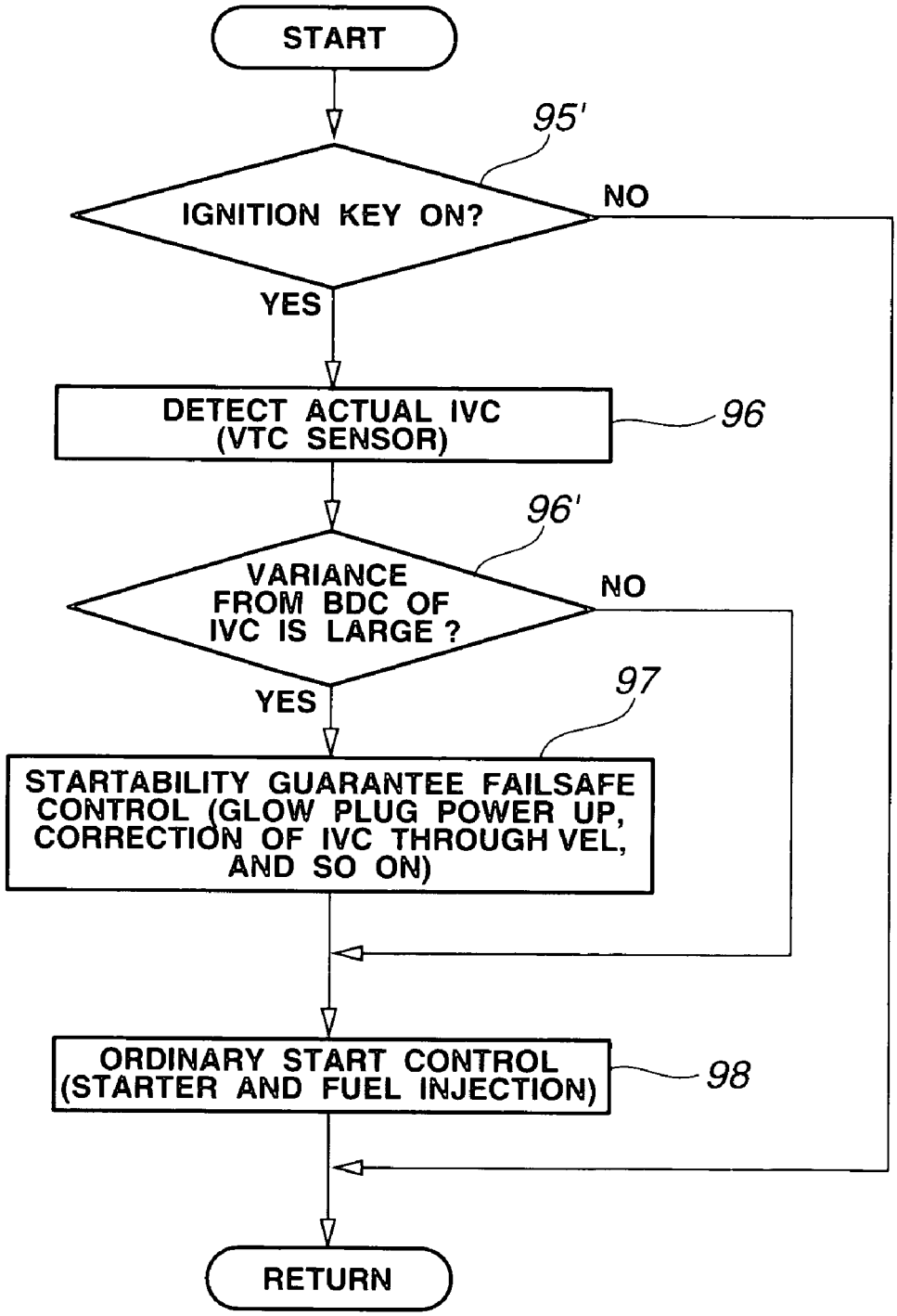
FIG. 13 is a flowchart representing a startability (start characteristic) guarantee fail safe control used in the third embodiment of the variably operated valve system shown in FIG. 12.

A third preferred embodiment of the variably operated valve system will be described below with a chief reference of FIG. 12. FIG. 12 shows a control flowchart of a control function which guarantees the start characteristic during the subsequent start after the engine stop. That is to say, at a step 91' of FIG. 12, control unit 6 determines whether an ignition key (switch) is turned off. If the ignition key switch 91' is turned off (Yes), the routine goes to a step 91. At step 91, control unit 6 issues a signal for oil control valve 39 to move the IVC toward the BDC (in the case of the embodiment shown in FIG. 7A, the signal is issued for the IVC to move toward the advance angle side and, in the case of the embodiment shown in FIG. 11, the signal is issued for the IVC to move toward the retardation angle side). At a step S92, control unit 6 detects an actual IVC via VTC phase sensor 200. Then, at a step S92', control unit 6 determines whether the IVC is moved toward the BDC. If the actual IVC is not moved toward the BDC (No) at step 92', the routine goes to a step 92". At step 92", control unit 6 determines whether a predetermined time has passes. If not passed (No), the routine returns to step 91. If passed (Yes) at step 92" or if the IVC is approximately equal to the BDC (Yes) at step 92', control unit 6 issues an engine stop signal to stop the fuel injection through fuel injection valve 4 to halt operation of engine 1. On the other hand, if the IVC is not the BDC, the routine returns to step 91 to control oil control valve 39 so as to repeat the control operation to achieve IVC→BDC. If actual IVC is not approached near to the BDC due to the failure in oil control valve 39 at any more, engine 1 is forcefully stopped after the predetermined time (for example, 30 seconds) has passed. As described above, the position of fitting of hydraulic (pressure) piston 110 to fix vane main frame 22 onto cam axle timing pulley 14 is set such that the IVC is approximately equal to the BDC. Hence, at a time point at which it is determined that the IVC is approximately equal to the BDC, engine 1 is stopped. At this time, since the pressure of the oil pump is reduced, an action of piston return spring 112 (refer to FIG. 6) causes hydraulic piston 110 to be fitted onto seat 111 so as to fix the IVC to be approximately equal to the BDC. Hence, at the subsequent start of engine 1, vane main frame 22 is fixed to cam axle timing pulley 14 under a state of the IVC which is approximately equal to the BDC. A fluctuation vibration of hydraulic vane main frame 22 can, thus, be avoided. At step 93, even in a case where engine 1 is stopped (at a step 93') under a state where the IVC is detached from the BDC, at a step 94, bias springs 25 automatically set vane main frame 22 at a position at which the IVC is approximately equal to the BDC. At a step 95, hydraulic piston 110 causes vane main frame 22 for the IVC to be locked at the position of the BDC. Hence, the control operation in accordance with FIG. 12 gives a high reliability. The operations at steps 93 and 94, in most cases, cause the IVC to be in the state where the IVC is approximately equal to the BDC during the engine start. However, in a case where the mechanism of hydraulic vane main frame 22 has failed, even the action of bias springs 25 often causes the IVC to be varied (detached) from the BDC. If no countermeasure is taken, the reliability of engine start is reduced. Thus, a startability (start characteristic) guarantee fail-safe control logic shown in FIG. 13 can be added. If the ignition switch is turned on (Yes at a step 95'v) and the IVC is largely varied from the BDC through VTC sensor 200 (Yes at a step 96'), the start characteristic guarantee fail safe control at a step 97 is executed. In this control, by increasing an applied current to glow plug 8, an evaporation of fuel is promoted. Even if the effective compression ratio is lowered, there is a method of assuring the combustion. There is a method in which an electrical heater is arranged in intake system 16 to previously increase a temperature of intake air. Furthermore, the electrical heater heats the fuel itself and promotes the evaporation of fuel.

In addition, there is an effective method of modifying the fuel injection pattern, as shown in FIG. 5, to support the engine start in a common rail fuel injection system. That is to say, at step 95' of FIG. 13, control unit 6 determines whether an ignition key switch is turned on. Then, when the ignition switch is turned on (Yes) at step S95', the routine goes to steps 96 and 96'. At step 96', control unit 6 determines whether the variance of the IVC from the BDC is large. If the IVC is approximately equal to the BDC (bottom dead center), control unit 6 skips the control operation of step 97 and performs the ordinary start control of engine 1 at a step 98 (at step 98, the modification of the fuel injection pattern is carried out). An operation of step 97 introduces the increase in the fuel consumption. However, even if the IVC is detached from the BDC, namely, even if the control operation by means of bias springs 25 is not executed in the way an intention at the first time, engine 1 can assuredly be started. In the variably operated valve system, in addition to the system which has changed the phase angle, there is another system (VEL (a variable event-and-lift mechanism)) which continuously varies the lift of, for example, intake valve 9 as disclosed in a Japanese Patent Application First Publication No. 2004-76618 published on Mar. 11, 2004. The operation of bias spring in a fourth embodiment shown in FIG. 14 will be described below. That is to say, in FIG. 14, two intake valves 9 are arranged per cylinder. The movements of two intake valves 9 are the same. Driving axle 202 is driven one-half revolution crankshaft 2 in a case of the four-stroke engine. In the case of the two-stroke engine, driving axle 202 is driven at the same number of revolutions as crankshaft 2.

Phase varying section as shown in FIG. 6 can be interposed between driving axle 202 and cam axle timing pulley 14. In this case, valve open-and-closure timing (phase) and lift of each of intake valves 9 can simultaneously and universally be controlled. In the embodiment according to the present invention, a combination of these elements can be utilized or solely be utilized. The revolution of driving axle 202 is converted into swing movements of output cams 204 via a link arm 216 and a rocker arm 203 by means of an eccentric cam 212 and carry out the open operations of intake valves 9. Another eccentric cam 211 is disposed on rocker arm 203. The revolution of a control axle 206 causes a fulcrum of rocker arm 203 to be varied and the lift of output cam 204 is varied. An exchange actuator 210 causes a ball screw axle 207 to be revolved. A movement of a nut 214 causes control axle 206 to be revolved. An input of a signal of position sensor 215 to ECU (control unit) 6 and a closed loop control for exchange actuator 210 can cause intake valves 9 to be opened at a target lift.

Figure 14:
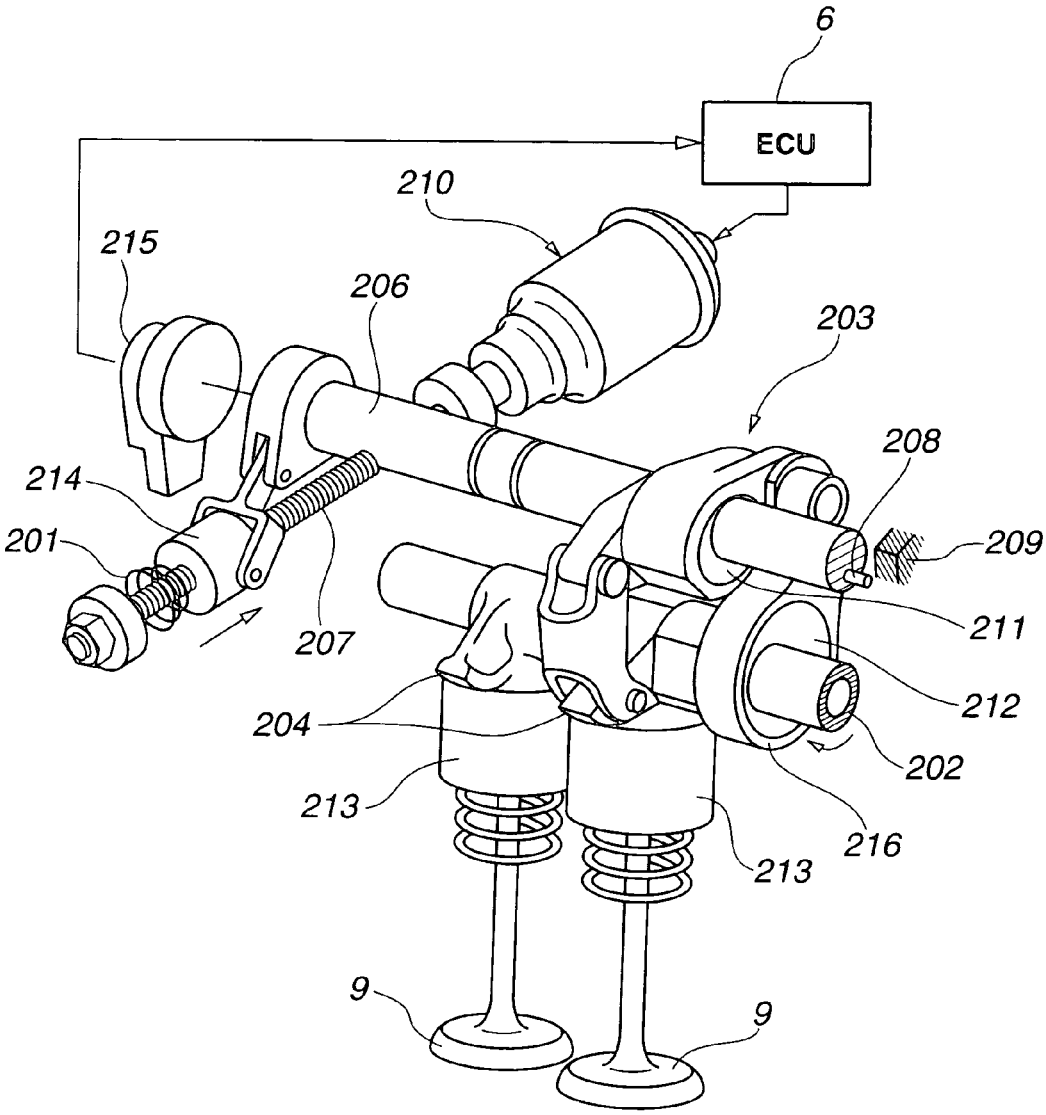
FIG. 14 is a configuration view of the variably operated valve system in a fourth preferred embodiment according to the present invention.
Figure 15:
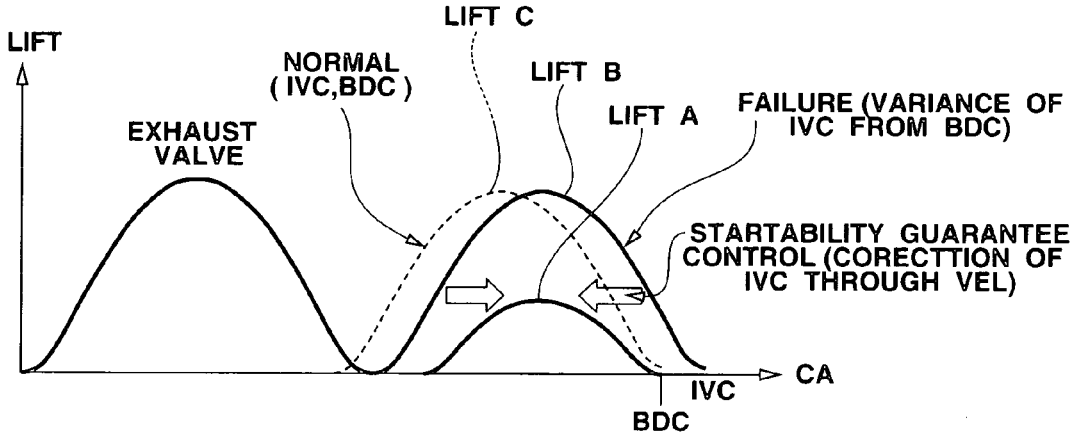
FIG. 15 is a characteristic graph of the intake valve in the fourth embodiment of the variably operated valve system shown in FIG. 14.

In the above-described embodiment shown in FIG. 14, bias spring 201 is added to the above elements. This bias spring 201 moves nut 214 toward an arrow-marked direction in FIG. 14 when no moment is acted upon exchange actuator 210. If nut 214 is moved in the arrow marked direction, control axle 206 is revolved in the counterclockwise direction. This counterclockwise directional revolution causes control axle 206 to be revolved until a pin 208 disposed on a tip of control axle 206 is brought in contact with a stopper 209 disposed on the cylinder head. Under a state in which pin 208 is contacted against stopper 209, the lift of each of intake valves 9 is small and the IVC is approximately equal to the BDC, as shown by a lift A in FIG. 15. In a case where an VTC phase control has failed (detached of IVC from bottom dead center BDC) as denoted by the start characteristic guarantee control (IVC correction through the VEL) of a step 97 in FIG. 13, the IVC during a whole lift (a lift B shown in FIG. 15) is detached from the BDC. However, if the lift of each of intake valves 9 is reduced through the VEL, namely, the action of bias spring 201 can set the IVC to be approached to the BDC. Hence, even in a case where the function of VTC (Variable Timing Control) shown in FIG. 6 is not carried out due to its failure so that the IVC is detached from the BDC, bias spring 201 can forcefully set the IVC to be approached to the BDC. In the control only through the VEL, the lift B (shown in FIG. 15) is set in which the IVC is retarded from the BDC when the lift is large. The phase control VTC causes the control in a normal state denoted by a broken line (a lift C shown in FIG. 15) in which the IVC approaches to the BDC. When the VTC is not present and the lift is excessively large, the position of the failure (detachment (variance) of IVC from bottom dead center BDC) in FIG. 15 is set. At this time, the operation of exchange actuator 210 causes the lift to be increased and decreased (adjusted) according to the driving state of engine 1. If operation of exchange actuator 210 is stopped, bias spring 201 causes the IVC to be approximately equal to the BDC in a de facto state. Therefore, in a case where the sole of VEL is used, the effective compression ratio is increased and the startability (start characteristic) of engine 1 can be improved. It is noted that the term of variance recited in FIG. 13 corresponds to the term of detachment (or separation).

This application is based on a prior Japanese Patent Application No. 2005-127788 filed in Japan on Apr. 26, 2005, the disclosures of which are hereby incorporated by reference.

What is claimed is:

1. A variably operated valve system for a compression ignition engine, comprising:

an adjustment mechanism that is controlled by means of a control section to detach an intake valve closure timing from a bottom dead center in accordance with an engine driving condition; and an engine start securing section that guarantees an engine start even at least one of cases during a failure in the control section, during a stop of the engine, and during a start of the engine, wherein the engine start securing section comprises a mechanical bias section, installed in the adjustment mechanism, that biases the adjustment mechanism to be directed for the intake valve closure timing to approach to a position, prior to an initial explosion, near the bottom dead center which is a most advanced angle position during at least one of the following cases: during the failure in the control section, during the stop of the engine, and during the start of the engine.

2. The variably operated valve system for the compression ignition engine as claimed in claim 1, wherein the adjustment mechanism comprises at least one of a phase adjustment mechanism configured to varie a phase of intake valve open and closure with respect to a crank angle of the engine and a lift adjustment mechanism that varies a lift of the intake valve.

3. The variably operated valve system for the compression ignition engine as claimed in claim 2, wherein the adjustment mechanism comprises the phase adjustment mechanism and a most advance angle position of the intake valve closure timing is set to a position nearer to the bottom dead center than a most retardation angle position of the intake valve closure timing and the mechanical bias section is acted on the phase adjustment mechanism to be in a state of the most advance angle position.

4. The variably operated valve system for the compression ignition engine as claimed in claim 2, wherein the adjustment mechanism comprises the lift adjustment mechanism and a most advance angle position of the intake valve closure timing is set to a position nearer to the bottom dead center than a most retardation angle position of the intake valve closure timing and the mechanical bias section is acted on the lift adjustment mechanism to be in a state of the most advance angle position.

5. The variably operated valve system for the compression ignition engine as claimed in claim 2, wherein the adjustment mechanism comprises the phase adjustment mechanism and a most retardation angle position of the intake valve closure timing is set to a position nearer to the bottom dead center than a most advance angle position of the intake valve closure timing and the mechanical bias section is acted on the phase adjustment mechanism to be in a state of the most retardation angle position.

6. The variably operated valve system for the compression ignition engine as claimed in claim 2, wherein the adjustment mechanism comprises the lift adjustment mechanism and a most retardation angle position of the intake valve closure timing is set to a position nearer to the bottom dead center than a most advance angle position of the intake valve closure timing and the mechanical bias section is acted on the lift adjustment mechanism to be in a state of the most retardation angle position.

7. The variably operated valve system for the compression ignition engine as claimed in claim 1, wherein the start securing section comprises a control unit that transmits a signal to control the intake valve closure timing in a state near to the bottom dead center to the control section and, thereafter, outputs a stop signal of the engine during the stop of the engine.

8. The variably operated valve system for the compression ignition engine as claimed in claim 1, wherein the start securing section comprises an engine startability guarantee fail-safe control function that supports the start of the engine in a case where the intake valve closure timing is detached from the bottom dead center during the start of engine.

9. The variably operated valve system for the compression ignition as claimed in claim 1, wherein the start securing section comprises a control function to modify a fuel injection pattern on the basis of an information on a position of the intake valve closure timing.

10. The variably operated valve system for the compression ignition as claimed in claim 2, wherein the phase adjustment mechanism comprises: an intake cam axle on which an intake cam for an intake valve is attached; a hydraulic vane main frame to which the intake cam is fixed; a cam axle timing pulley which is fixed to a hydraulic housing, the hydraulic vane frame being housed within the hydraulic housing, being sealed against a front cover, and having four vanes to each side of which a hydraulic pressure is applied so as to enable phases of hydraulic vane main frame and hydraulic housing to be varied, a phase difference between the hydraulic vane main frame and the hydraulic housing causing an intake valve closure timing to be varied during an ordinary driving of the engine; a plurality of bias springs interposed between side survaces of the vanes and stopper surfaces of the hydraulic housing and biasing the cam axle in the advance angle direction; at least one advance angle hydraulic chamber and at least one retardation angle hydraulic chamber, both of the advance angle and retardation angle hydraulic chambers being defined by the hydraulic vane member and the hydraulic housing, oil being supplied into the advance and retardation angle hydraulic chambers via advance angle hydraulic passage, retardation angle hydraulic passages, an advance angle hydraulic hole, and a retardation angle hydraulic hole; and a hydraulic piston which is fitted onto a seat so that the hydraulic vane main frame is fixed to the cam axle timing pulley, the position of the fitting of the hydraulic vane main frame being set to a position at which the intake valve closure timing is approximately equal to the bottom dead center.

11. The variably operated valve system for the compression ignition engine as claimed in claim 10, wherein the phase adjustment mechanism further comprises a bias spring to couple the hydraulic vane main frame to the front cover and to bias the intake cam axle in the advance angle direction, hooks of both ends of the bias twist spring being connected to twist spring hook inserting holes of the hydraulic vane main frame and the front cover.

12. The variably operated valve system for the compression ignition engine as claimed in claim 11, wherein, in a case where the hydraulic of the advance angle hydraulic chamber is equal to or larger than that of the retardation angle hydraulic chamber, operations of intake valve open and closure with respect to a revolution of the cam axle timing pulley are carried out at earliest timings.

13. The variably operated valve system for the compression ignition engine as claimed in claim 11, wherein, in a case where no hydraulic is acted upon both of the advance and retardation angle hydraulic chambers, the bias spring automatically controls operations of intake valve open and closure timings to be in a most advance angle position.

14. The variably operated valve system for the compression ignition engine as claimed in claim 11, wherein, in a case where the hydraulic of the retardation angle hydraulic chamber is larger than the advance angle hydraulic chamber, the operations of intake valve open and closure timings with respect to the revolution of the cam axle timing pulley are in a most retardation angle position with respect to the crank angle.

15. The variably operated valve system for the compression ignition engine as claimed in claim 13, wherein the bias spring constitutes the mechanical bias section.

16. The variably operated valve system for the compression ignition engine as claimed in claim 11, wherein the bias twist spring constitutes the mechanical bias section.

17. The variably operated valve system for the compression ignition engine as claimed in claim 11, wherein an oil control valve is disposed in a hydraulic passage between the advance angle hydraulic passages and retardation angle hydraulic passages, the oil control valve comprising: a solenoid connected to the control section; a spool portion; and a spool bias spring, the spool bias spring causing the spool portion of the oil control valve in a de facto state in which the valve closure timing is at the most advance angle position which corresponds to the bottom dead center and the hydraulic main frame is in a state approaching to the bottom dead center by means of the respective bias spring.

18. The variably operated valve system for the compression ignition engine as claimed in claim 8, wherein the startability guarantee failsafe function includes a method of increasing an applied current of a glow plug to promote a fuel evaporation.

19. The variably operated valve system for the compression ignition engine as claimed in claim 2, wherein the lift adjustment mechanism comprises: a driving axle connected with an intake cam timing pulley so as to be synchronized with a revolution of an engine crankshaft and a revolution of the driving axle being converted into a swing motion of an output cam via a link arm and a rocker arm, the swing motion of the output cam performing an open operation of an intake valve via a tappet; an eccentric cam which is arranged on the rocker arm and revolving a control axle for a fulcrum of the rocker arm to be varied so that the lift of the output cam is varied; and an exchange actuator causing a ball screw axle to be revolved and a nut is moved to revolve the control axle; and another bias spring which constitutes the mechanical bias section and which is moved on the nut to bias the control axis to be revolved until a pin installed on a tip of the control axle is contacted on a stopper.

* * * * *